US005240255A

United States Patent [19]

Barlow

[11] Patent Number: 5,240,255

[45] Date of Patent: Aug. 31, 1993

[54] BOARD GAME WITH MOLDABLE PLAYING PIECES

[75] Inventor: Gordon A. Barlow, Highland Park, Ill.

[73] Assignee: Gordon Barlow Design, Highland Park, Ill.

[21] Appl. No.: 833,377

[22] Filed: Feb. 10, 1992

[51] Int. Cl.[5] ..... A63F 3/00

[52] U.S. Cl. ..... 273/243; 273/287; 273/288

[58] Field of Search ..... 273/241, 276, 287, 243, 273/288

[56] References Cited

U.S. PATENT DOCUMENTS

| | | | |
|---|---|---|---|
| 3,298,692 | 1/1957 | Glass et al. | 273/276 |
| 3,754,763 | 8/1973 | Breslow | 273/243 |
| 4,291,884 | 9/1981 | Bass et al. | 273/288 |
| 4,333,655 | 6/1982 | Rudell et al. | 273/241 |
| 4,348,029 | 9/1982 | Barlow | 273/249 |

*Primary Examiner*—Benjamin H. Layno
*Attorney, Agent, or Firm*—Kinzer, Plyer, Dorn, McEachran & Jambor

[57] ABSTRACT

A table top board game including a game board having a plurality of playing pieces. Each playing piece is formed of a soft moldable easily deformable material in the shape of an upstanding figurine. A mold is provided for molding new playing pieces and repairing playing pieces which have been deformed during the course of the game. A path of travel for the playing pieces is depicted on the game board. This path of travel includes a series of discrete stations each of which is spaced apart a sufficient distance from another station so that a station can receive one of the playing pieces without that playing piece interfering with another playing piece positioned on an adjacent station. The playing piece cutting mechanism includes a scissors-like mechanism having a pair of blades one of the blades being movable relative to the other blade by a link which is driven by the crank operated mechanism. The twisting mechanism includes a clothes pin-like playing piece grasping mechanism to hold one end of a playing piece and a wrench-like mechanism to engage the opposite end of a playing piece and to twist it relative to the end held fixed. The crushing mechanism includes a boot-like mechanism which is reciprocated up and down on the top of a playing piece and the flattening mechanism includes a grooved roller which runs over a playing piece from head to toe.

9 Claims, 5 Drawing Sheets

FIG. 1
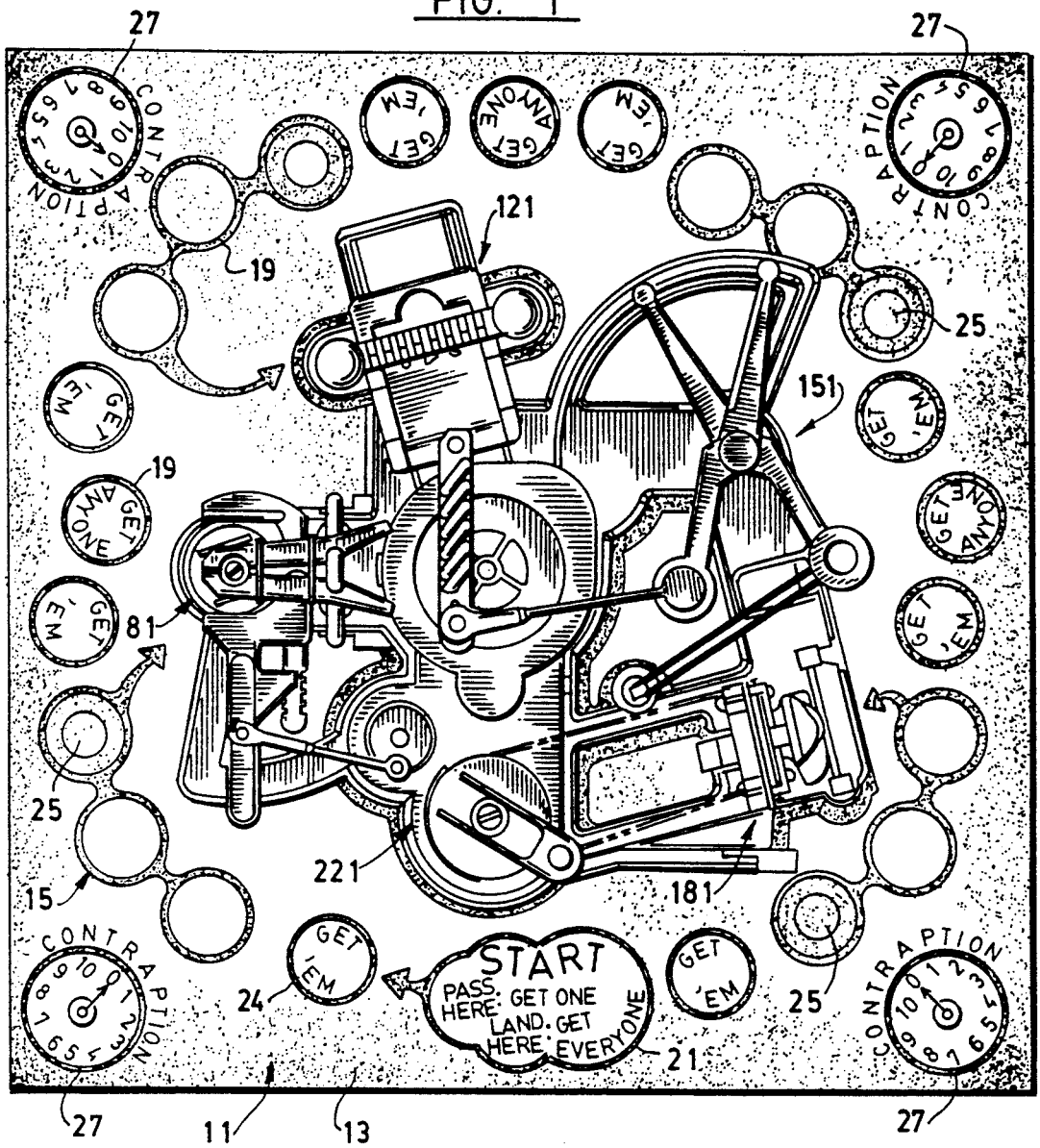
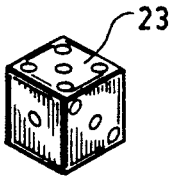
FIG. 2
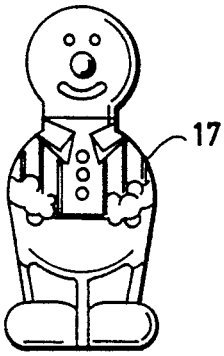
FIG. 3
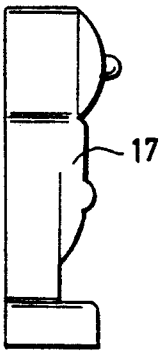
FIG. 4

FIG. 5
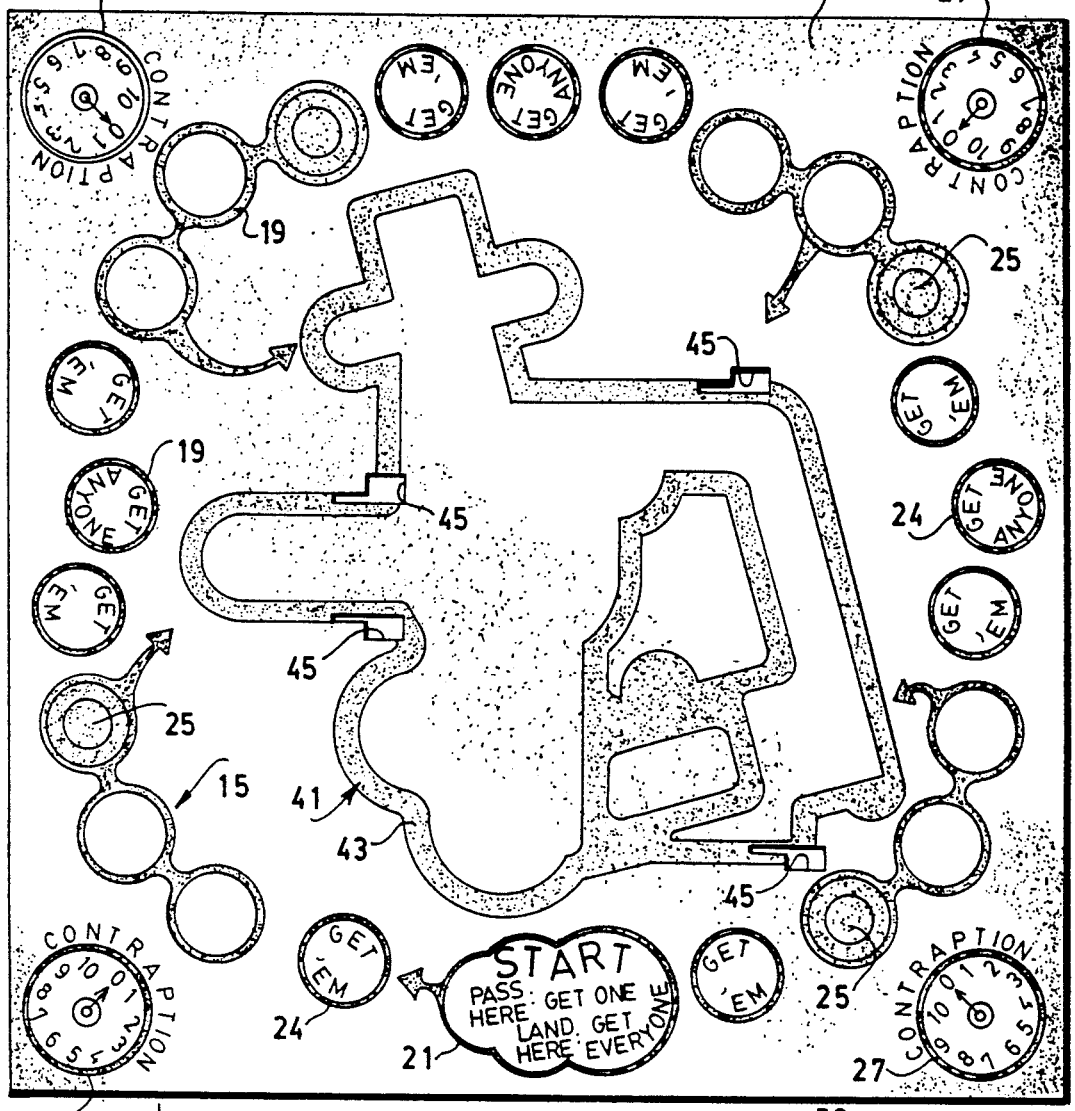
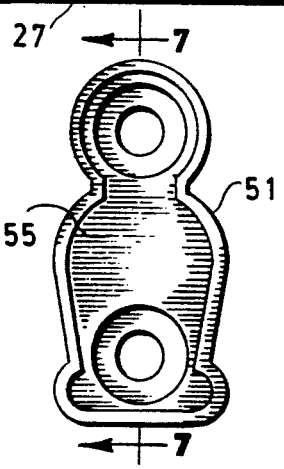
FIG. 6
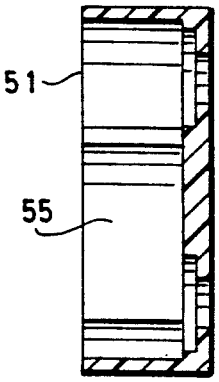
FIG. 7
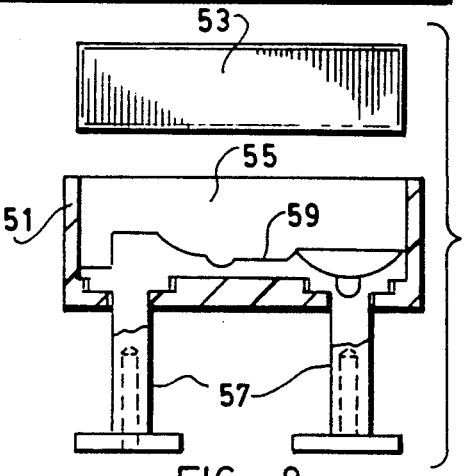
FIG. 8

FIG. 9
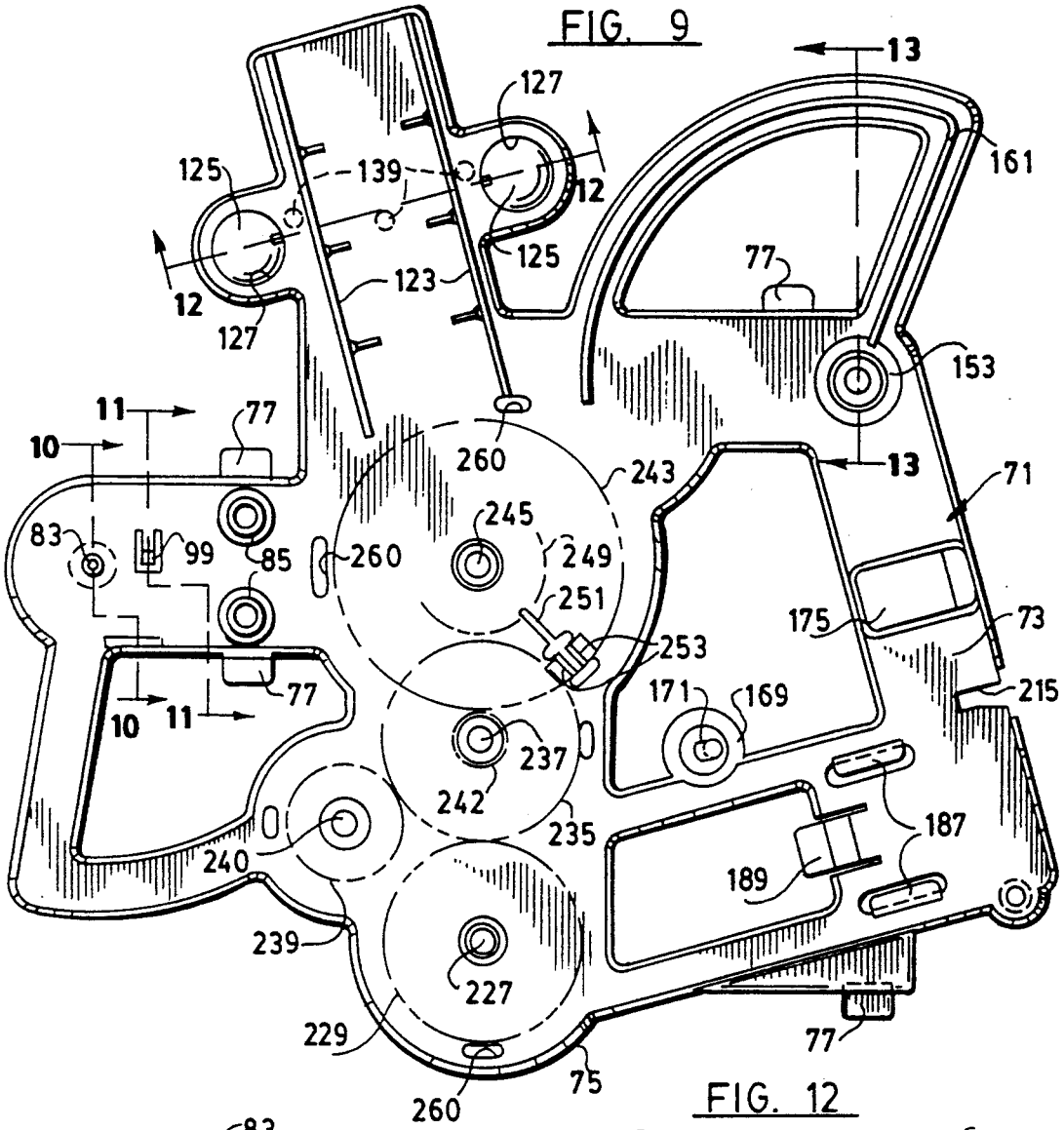
FIG. 12
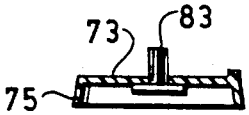
FIG. 10
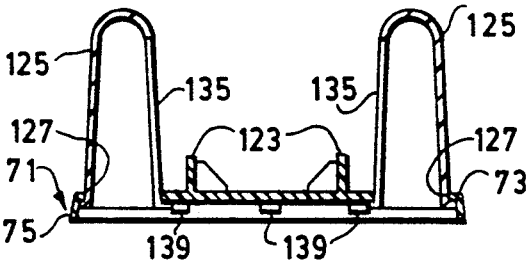
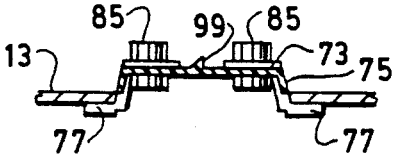
FIG. 11
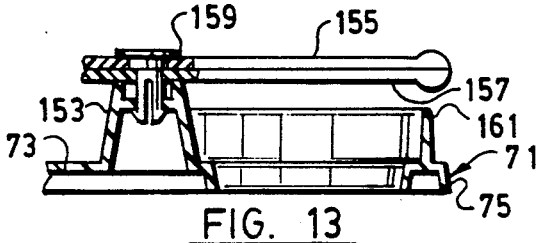
FIG. 13

BOARD GAME WITH MOLDABLE PLAYING PIECES

BACKGROUND AND SUMMARY OF THE INVENTION

The invention relates to a table top board game suitable for play by one to four players who may range in age from young children to mature, but fun-loving adults.

An object of this invention is a table top board game which permits the players to harmlessly vent their frustrations and angers, not against each other, but against each other's playing pieces which consist of soft molded easily deformable upstanding figurines. The players vent their frustrations and angers by subjecting an opponent's figurine to twisting, cutting, crushing or flattening so as to completely distort the playing piece and cause it to be removed from the playing board.

Another object of this invention is a table top board game in which a player may select any one of four mechanisms for distorting his opponent's playing piece.

Another object of this invention is a table top board game in which various playing piece distortion mechanisms can be operated simultaneously by the rotation of a crank.

Another object of this invention is a table top board game in which soft moldable easily deformable playing pieces may be remolded so that the pieces ca be used repeatedly.

Other objects may be found in the following specification, claims and drawings.

BRIEF DESCRIPTION OF THE DRAWINGS

The invention is illustrated more or less diagrammatically in the following drawings wherein:

FIG. 1 is a top plan view of the table top game board of this invention shown on a reduced scale;

FIG. 2 is a perspective view of a die used in playing the game;

FIG. 3 is a front elevational view of a molded playing piece used in playing this game;

FIG. 4 is a side elevational view of the playing piece of FIG. 3;

FIG. 5 is a top plan view of the game board with the actuating mechanism removed;

FIG. 6 is a top plan view of a playing piece mold;

FIG. 7 is a cross sectional view taken along line 7—7 of FIG. 6;

FIG. 8 is an exploded side elevational view partially in cross section showing a stick of molding material prior to its insertion in the mold;

FIG. 9 is an enlarged top plan view of the operating mechanism housing which is installed on the game board;

FIG. 10 is a cross sectional view taken along line 10—10 of FIG. 9;

FIG. 11 is a cross sectional view taken along line 11—11 of FIG. 9;

FIG. 12 is a cross sectional view taken along line 12—12 of FIG. 9;

FIG. 13 is a cross sectional view taken along line 13—13 of FIG. 9;

DESCRIPTION OF THE PREFERRED EMBODIMENTS

Figure 21:
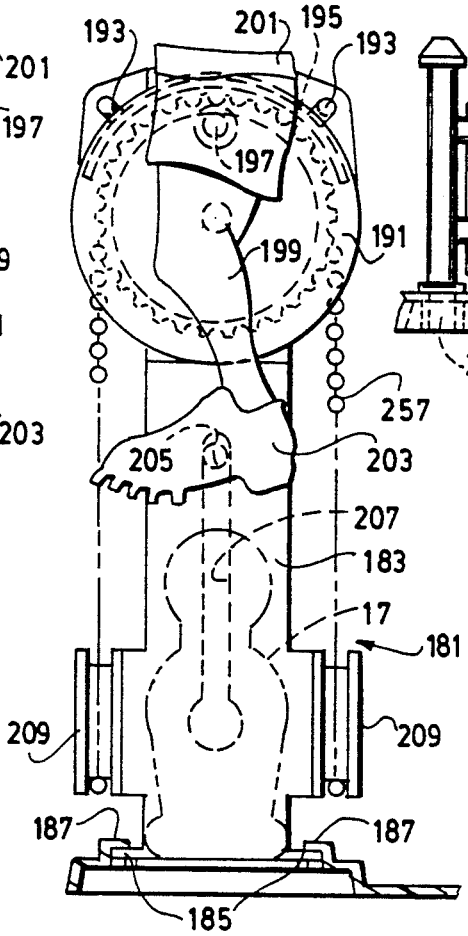
FIG. 21 is a side elevational view of the mechanism of FIG. 20.
Figure 22:
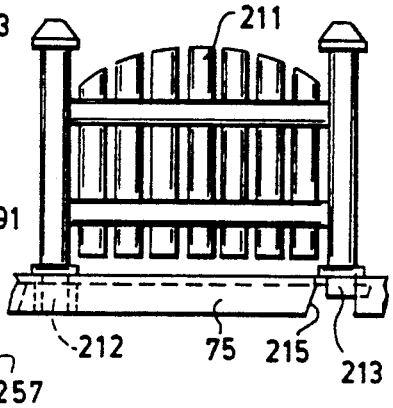
FIG. 22 is a front elevational view of a playing piece retaining gate.

An embodiment of the invention is shown in an overview in FIGS. 1 through 4 of the drawings in which 11 is a table top game embodying the novel features of this invention. It includes a game board 13 which is conventionally made of heavy cardboard or pressed board which conventionally may be folded about a center line. A path of travel 15 for playing pieces 17 shown in FIGS. 3 and 4 of the drawings is provided on the top face of the game board 13 by printing, silk screening or any other conventional method. The path of travel 15 includes a number of discrete stations 19 indicated by connected or disconnected circles. The balloon shaped FIG. 21 depicted on the surface of the game board indicates the starting point for the playing pieces. The movements of the playing pieces 17 are controlled by rolling the die 23 shown in FIG. 2. The number which turns up on the die indicates the number of discrete stations 19 to which a playing piece may be moved during any one turn of a player. Some of the discrete stations such as station 24 have lettering which indicates that the player moving his playing piece is permitted to pick up playing pieces 17 of other players which are on target stations such as those indicated by numeral 25 and subject these playing pieces to distortion. The target stations 25 are indicated by multiple concentric circles. Counters 27 are snapped into openings in the playing board and one is provided for each player.

The game board 13 is shown in FIG. 5 prior to the installation of the other parts of the table top game thereon. It has an irregularly shaped design 41 in the center thereof surrounded by a narrow decorative border 43 which may be printed or painted thereon. The design 41 provides a template for installing the mechanical portion of the game on the game board 13. Keyhole slots 45 with rectangular portions are formed in the board to permit attachment of other portion of the table top game to the game board.

FIGS. 6 through 8 of the drawing show a mold 51 used for making and repairing the playing pieces 17. The playing pieces are manufactured using a block 53, shown in FIG. 8, of a soft moldable easily deformable material which is generally sold for children under the generic designation "non-toxic molding material". The mold has a cavity 55 which receives the block of material and two push out pins 57 connected to a mold face 59. The mold face fits inside the mold cavity and provides the figurine shape to the block 53 of molding compound.

The equipment base 71 is shown in FIGS. 9 through 13 of the drawings. It may be conventionally injection molded in the form of a thin piece of plastic having a top surface 73 and a downwardly extending exterior rim 75. Downwardly extending L-shaped feet 77 are formed integrally with the top surface 73 and are positioned to fit through the larger portions of the keyhole slots 45 in the game board 13 so that the equipment base can then be slid to the left as shown in FIG. 5 of the drawings to lock the equipment base in position on top of the game board 13. Portions of the equipment base 71 provide mounting means for the cutting, crushing, twisting and flattening mechanisms to be hereinafter described.

Figures 14, 15, 16, 17:
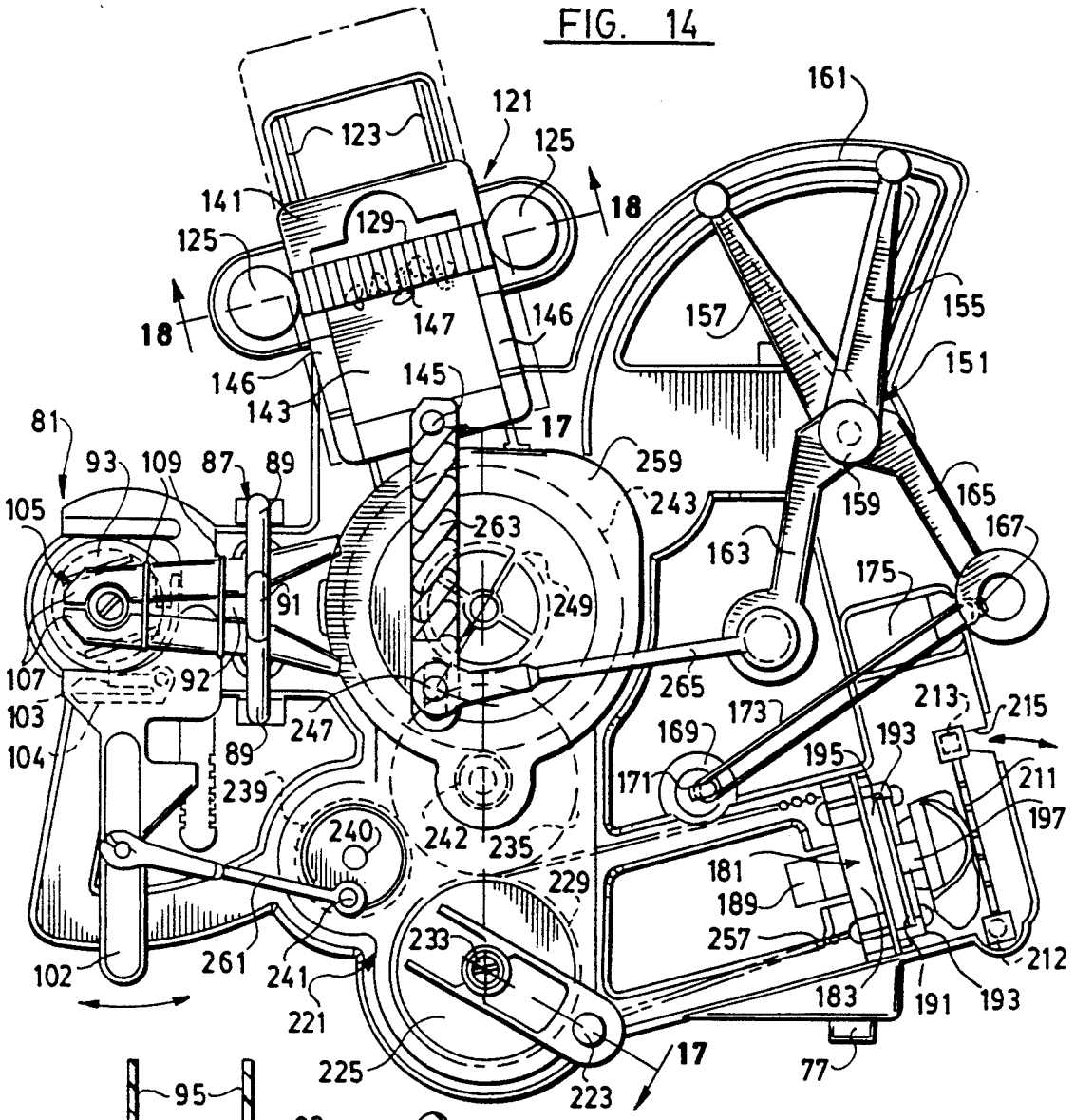
FIG. 14 is an enlarged top plan view of the operating mechanism of the game board of this invention.
FIG. 15 is a cross sectional view of the playing figure twisting platform.
FIG. 16 is a bottom elevational view of the playing figure twisting platform of FIG. 15.
FIG. 17 is a cross sectional view taken along line 17—17 of FIG. 14.

Twisting mechanism 81 is shown in detail in FIGS. 9, 10, 11, 14, 15 and 16 of the drawings. A pivot post 83 for the mechanism is shown in FIGS. 9 and 10 of the drawings. A pair of shouldered tubular stubs 85 shown in FIGS. 9 and 11 of the drawings extend through the top surface 73 of the equipment base 71. A somewhat cross shaped mounting clip 87 is mounted on the stubs 85 through means of its two legs which fit into the tubular stubs. The mounting clip 87 has horizontally extending arms 89, an upstanding center pivot post 91 and a horizontally projecting stop 92 shown most clearly in FIG. 14 of the drawings. A rotatable platform 93, shown most clearly in FIGS. 15 and 16 of the drawings, is mounted for rotation on the pivot post 83 shown in FIG. 10 of the drawings. The platform 93 has a pair of upstanding walls 95 which receive and grip a playing piece 17 standing in position on the platform 93. Ratchet teeth 97 are formed on the bottom surface of the rotatable platform 93 as shown in FIG. 16 of the drawing and these teeth engage a pawl 99 formed in the top surface 73 of the equipment base 71 and shown most clearly in FIG. 9 of the drawings. The purpose of the pawl 99 is to engage the ratchet teeth 97 to limit rotation of the platform 93 to a clockwise direction as shown in FIG. 14 of the drawings. Peripheral ratchet teeth 101 are formed on the circumferential side of the rotatable platform 93 as shown in FIG. 15 of the drawings and these teeth are engaged by a wrench replica 102 shown in FIG. 14 of the drawing to cause clockwise rotation of the rotatable platform 93 as shown in FIG. 14 upon oscillation of the wrench replica 102. The engagement between the wrench replica 102 and the ratchet teeth 101 is brought about by a tooth 103 formed as part of a U-shaped clip 104 attached to the underside of the wrench replica 102.

In order to hold a playing piece 17 in an upright position so that it can be twisted by engagement with the rotating upstanding walls 95 formed on the platform 93, a clothes pin-like device 105 formed of a pair of clothes pin arms 107 is supported on the mounting clip 87 and held together in closing contact by means of two rubber bands 109. When the arms are spread apart, a playing piece 17 may be inserted between the arms 107 and the rubber bands 109 will bring the arms into clamping engagement with the playing piece. With the upper portion of a playing piece 17 clamping in position between the cloths pin arms 107, oscillation of the wrench replica 102 will rotate the platform on which a playing piece 17 is standing in a clockwise direction as viewed in FIG. 14 of the drawings. Because the lower portion of a playing piece is held between the upstanding walls of the platform, the lower portion of the playing piece will rotate with the platform thus twisting the playing piece.

A thickness flattening mechanism 121 is shown in FIGS. 9, 12, 14, 18 and 19 of the drawings. It includes a pair of rails 123 formed integrally with the top surface 73 of the equipment base 71 which rails are located between a pair of upstanding hollow posts 125 extending through openings 127 formed in the top surface 73 of the equipment base 71. The hollow posts need not be formed separately but can be molded integrally with the equipment base 71. A ribbed roller 129 shown most clearly in FIGS. 14 and 18 of the drawings extends between the hollow posts 125 and is biased downwardly by a pair of tension springs 131 each located inside a hollow post 125. Trunnions 133 at the ends of the rib roller 129 extend through vertical slots 135 in the hollow post 125 to engage the ends of the torsion springs 131. The opposite ends of the torsion springs are connected to a rod 137 which extends between the bottoms of the hollow post and is held in position between misaligned bosses 139, the middle boss having a notch formed therein.

Figure 18:
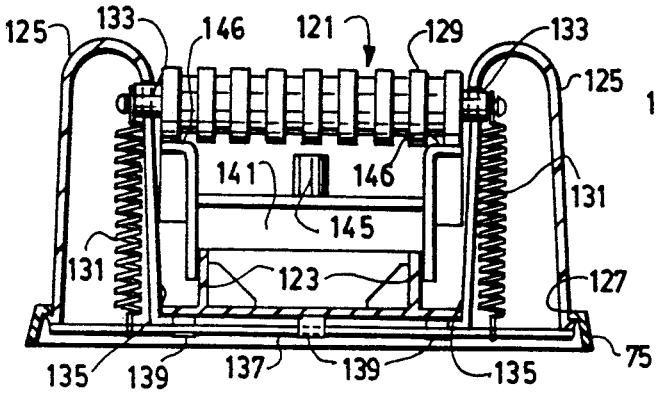
FIG. 18 is a cross sectional view taken along line 18—18 of FIG. 14.
Figure 19:
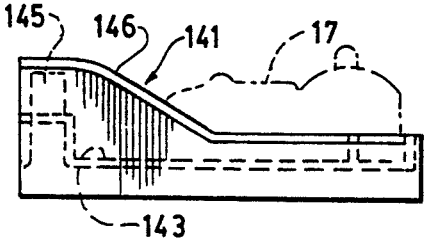
FIG. 19 is a side elevational view of a playing piece, shown in phantom lines, lying in a bed mechanism which carries the playing piece under the roller mechanism of FIG. 18.
Figure 20:
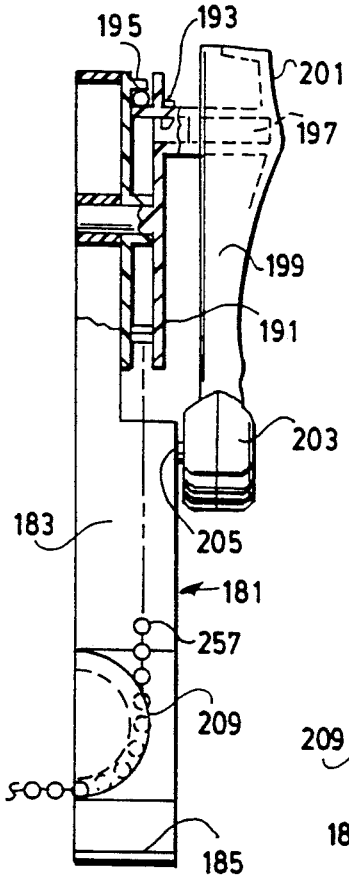
FIG. 20 is a partial front elevational view, with some parts in cross section, showing the playing piece crushing mechanism.

A sled 141 shown in FIGS. 14, 18 and 19 has a well 143 which receives a recumbent playing piece 17. The sled rides on the rails 123 beneath the ribbed roller 129. The sled has a stanchion 145 at one end to permit it to be pulled under the roller in a manner to be hereinafter described. As shown in FIG. 18, the roller 129 rides on shoulders 146 formed on the side walls of the sled 141. The shoulders are higher than the thickness of a playing piece 17 at the stanchion end of the sled and are ramped down to the opposite end of the sled where they are lower than the thickness of the playing piece. The roller 129 may be ribbed as shown. The sled 141 may be formed with a mirror image word 147 in the bottom thereof such as the word "splat" as shown in FIG. 14 of the drawings. So that the word "splat" is formed in bas relief on the back of the flattened playing piece. The face of the playing piece would be ribbed in a mirror image of the roller 129.

A playing piece cutting mechanism 151 is shown in detail in FIGS. 9, 13 and 14 of the drawings. A tapered open top mounting post 153 is formed integrally with the top surface 73 of the equipment base 71. A pair of scissor blades 155 and 157 are pivotally mounted on top of the post 153 by means of a locking snap pin 159. The tips of the scissor blades swing over an arcuate rail 161 formed integrally with the equipment base 71. A handle 163 is formed integrally with scissors blade 155 and a handle 165 is formed integrally with scissors blade 167. A hook 167 is formed at the end of the handle 165. An upstanding stanchion 169 is formed integrally with the equipment base 71 and a hook 171 is formed at the upper end of the stanchion. A rubber band 173 connects between hook 171 and hook 167 of the scissors handle 165 to provide a biasing force against the scissors blade 157. A ramp 175 sloping upwardly and outwardly is integrally formed in the equipment base 71 and is engaged by the hook 167 projecting downwardly from the end of the handle 165 to force the handle 165 outwardly of the equipment base 71 as shown most clearly in FIG. 14 of the drawings. The rubber band 173 in addition to providing tension against the blades 155 and 157 of the scissors mechanism also functions as a safety feature to prevent the scissors from coming together and cutting an object such as a child's finger. Instead, the rubber band 173 will stretch beyond its normal extended position to prevent the blades 155 and 157 from coming together when the blades encounter opposition greater than that provided by an easily distortable figurine 17.

Referring now to FIGS. 1, 9, 14, and 20 to 22 of the drawings, a playing piece 17 height crushing mechanism 181 is depicted therein. This mechanism includes a tower 183 having a base 185 which extends laterally of the tower in opposite directions therefrom. The lateral extensions 185 fit under opposed raised ribs 187 formed integrally with the equipment base 71 as shown most clearly in FIG. 21 of the drawings. A spring tab 189 also molding integrally with the equipment base 71 and shown most clearly in FIG. 14 of the drawings engages the base 185 to lock the tower in position. A sprocket wheel 191 is pivotally mounted near the top of the tower on one side thereof. This wheel is held onto the tower by a pair of snap over detents 193 and an arcuate chain guard 195 is formed integrally with the tower. An outwardly extending eccentric stub 197 is formed on the sprocket wheel and a leg replica 199 is pivotally mounted on this eccentric stub. A pants replica 201 snaps over the upper portion of the leg replica as shown most clearly in FIG. 21 of the drawings. A two piece shoe replica 203 fits on the bottom of the leg replica and the inner shoe piece has an inwardly extending guide pin 205 with a hook (not shown) which fits into a guide slot 207 formed in the tower. Sprocket type idler wheels 209 are mounted on the opposite edges of the tower 183. A gate 211 shown in detail in FIG. 22 of the drawings has one post 212 pivotally mounted in an opening in the equipment base 71 and the opposite post has a foot 213 that fits into a converging slot 215 formed in the equipment base to lock the gate in a closed position. The gate prevents the playing piece 17 from moving out from beneath the crushing shoe replica 203 as it is crushed.

An actuating mechanism 221 which simultaneously operates the twisting mechanism 81, the flattening mechanism 121, the cutting mechanism 151 and the crushing mechanism 181 is shown in detail in FIGS. 9, 14, 17, 20 and 21 of the drawings. This actuating mechanism includes a hand operated crank arm 223 having an integral cover 225 which fits over a post 227 formed integrally with the equipment base 71. Located under the cover and over the post 227 is a main drive gear 229. An 0-ring 231 is positioned between the drive gear 229 and the crank arm cover 225 to function as a clutch between these two members. The crank arm cover 225, the gear 229 and the O-ring 231 are fastened together by a screw 233 which fits into the post 227. An idler gear 235 is mounted on a post 237 which is formed integrally with the equipment base 71. The idler gear 235 meshes with a gear 239 mounted on a post 240 formed integrally with the equipment base 71. The gear 239 has an upstanding eccentric stub 241 shown in FIG. 14. The idler gear 235 also has a spur gear 242 of reduced diameter which engages a gear 243 mounted on a post 245 formed integrally with the equipment base 71. The gear 243 has an upstanding eccentric post on the top thereof and an arcuate partial gear 249 on the lower side thereof which engages a clicker 251 held by posts 253 on the equipment base 241. The clicker makes sounds as the scissor blades 155 and 157 close. Sprocket teeth 255 formed on gear 229 engage a bead chain 257 which rotates the sprocket wheel 191 of the crushing foot tower 183.

A plastic cover 259 snaps into openings 260 in the equipment base 71 to enclose and cover the gears and bead chain.

As can be seen most clearly in FIG. 14, drive link 261 in the shape of a fanciful arm and hand connects the eccentric stub 241 on gear 239 to the wrench replica 102 of the playing piece twisting mechanism 81. A drive link 263 connects the eccentric post 247 of the gear 243 to post 145 on the sled 141 of the figurine flattening mechanism 121 to move it back and forth under the roller 129. Another drive link 265 also in the shape of a fanciful arm and hand is connected to the eccentric post 247 of the gear 243 and to the handle 163 of the scissors blade 155 of the playing piece cutting mechanism 151. The playing piece height crushing mechanism 181 is actuated by movement of the bead chain 257 which is moved by engagement with the sprocket teeth of main gear drive 229. Thus, it can be appreciated that clockwise rotation of the crank arm 223 of the actuating mechanism 221 operates all of the playing piece distortion mechanisms.

I claim:

1. A tabletop game including:

a game board, a plurality of playing pieces, each playing piece being formed of a soft, moldable easily deformable material in the shape of an upstanding figurine, a path of travel for said playing pieces depicted on said game board, said path of travel including a series of discrete stations, each of said series of discrete stations spaced apart a sufficient distance from said other stations to receive one of said playing pieces without said received playing piece interfering with another playing piece positioned on an adjacent station, a plurality of playing piece distortion means positioned on said game board contiguous to said path of travel of said playing pieces, said plurality of playing piece distortion means including individual playing piece distortion means, one of which cuts a playing piece, another of which crushes the height of a playing piece, and another of which flattens the thickness of a playing piece, and an actuating means interconnecting each of said distortions means to actuate said individual cutting, crushing and thickness flattening means.

2. The tabletop game of claim 1 in which said actuating means to actuate said individual cutting, height crushing and thickness flattening means includes means to actuate them simultaneously.

3. The tabletop game of claim 1 in which said actuating means to actuate said individual cutting, height crushing and thickness flattening means includes a manually operated crank.

4. The tabletop game of claim 1 in which said soft, moldable, easily deformable material of which each playing piece is formed is a molding compound.

5. The tabletop game of claim 1 in which said means to cut said playing piece includes a scissor-like mechanism having a pair of blades, one of said blades being moved relative to the other blade by a link which is driven by a rotatable post.

6. The tabletop game of claim 1 in which said means to crush a playing piece includes means to support a playing piece in an upstanding position, a replica of a leg and a shoe mounted for reciprocal movement up and down onto said playing piece and means to reciprocate said leg and said shoe.

7. The table top game of claim 1 in which said means to flatten the thickness of a playing piece includes means to support a playing piece in a recumbent position and a roller mechanism mounted above said support means so as to flatten said playing piece.

8. The tabletop game of claim 1 further comprising playing piece distortion means which twist a playing piece.

9. The tabletop game of claim 8 in which said means which twists a playing piece includes a clothes pin to engage the upper portion of a playing piece, a platform having upstanding walls to engage the lower portion of said playing piece therebetween and ratchet means to rotate said platform and said upstanding walls to twist said lower portion relative to said upper portion of said playing piece.

* * * * *